US008092885B2

(12) United States Patent
Tabib

(10) Patent No.: US 8,092,885 B2
(45) Date of Patent: Jan. 10, 2012

(54) SYSTEM FOR RESEALING OPEN BAGS

(76) Inventor: Anita Tabib, Newport Beach, CA (US)

( * ) Notice: Subject to any disclaimer, the term of this patent is extended or adjusted under 35 U.S.C. 154(b) by 0 days.

(21) Appl. No.: 12/479,523

(22) Filed: Jun. 5, 2009

(65) Prior Publication Data

US 2010/0195941 A1 Aug. 5, 2010

Related U.S. Application Data

(63) Continuation of application No. 10/960,458, filed on Oct. 7, 2004, now abandoned.

(51) Int. Cl.

| | |
|---|---|
| ***B32B 9/00*** | (2006.01) |
| ***B65D 65/28*** | (2006.01) |
| ***A47K 10/24*** | (2006.01) |

(52) U.S. Cl. ..... 428/40.1; 428/41.7; 428/41.8; 428/41.9; 428/42.1; 428/42.3; 428/43; 221/45; 221/282

(58) Field of Classification Search ..... 428/40.1, 428/41.7, 41.8, 41.9, 42.1, 42.2, 42.3, 43; 221/45, 282

See application file for complete search history.

(56) References Cited

U.S. PATENT DOCUMENTS

| | | | | |
|---|---|---|---|---|
| 4,902,141 | A * | 2/1990 | Linnewiel | 383/61.1 |
| 4,911,563 | A * | 3/1990 | Ciani | 383/89 |
| 4,928,864 | A * | 5/1990 | Walker et al. | 224/162 |
| 5,044,776 | A * | 9/1991 | Schramer et al. | 383/89 |
| 5,215,236 | A * | 6/1993 | Waddell | 224/218 |
| 5,794,815 | A * | 8/1998 | Carlson et al. | 221/45 |
| 7,073,309 | B2 * | 7/2006 | van Driesten | 53/415 |
| 2002/0033238 | A1 * | 3/2002 | Downs | 156/577 |
| 2010/0252567 | A1 * | 10/2010 | Konsti | 221/307 |

* cited by examiner

*Primary Examiner* — Victor Chang
(74) *Attorney, Agent, or Firm* — William L. Chapin

(57) ABSTRACT

Embodiments of the present invention relate generally to adhesive strips for reversibly resealing open bags, such as food bags. More particularly, the preferred strips comprise a decorative motif and/or a textured surface, which may be provided in a dispenser.

4 Claims, 5 Drawing Sheets

SYSTEM FOR RESEALING OPEN BAGS

This application is a continuation of U.S. application Ser. No. 10/960,458 file on Oct. 7, 2004, now abandoned.

BACKGROUND OF THE INVENTION

1. Field of the Invention

Embodiments of the present invention relate generally to adhesive strips for reversibly resealing open bags. More particularly, the preferred strips comprise a decorative motif and/or a textured surface.

2. Description of the Related Art

Many food items are sold in disposable bags. One can obtain potato chips, tortilla chips, cookies, crackers, bread, and myriad other food items in such packaging. These bags may be made of plastic/polymer materials, foil-type materials, paper, and other materials well known to those of skill in the art. However, with the rare exception, such food packages are not resealable.

Nonfood items are also sold in disposable bags. These could range from paper clips to cement. To prevent loss of product, for example, from exposure to the atmospheric elements, or from items spilling out of a package if it is dropped, there is a need to reseal the packaging.

As is well known, potato chip bags, as an example, once opened, do not come with an integral sealing mechanism. Thus, food packaged in such bags will quickly become stale after the bag is opened if the food is not repackaged and resealed. This problem often encourages consumers to consume the entire potato chip bag to prevent such waste. A variety of methods have been proposed to reseal and/or repackage the food items before they go stale.

The bag clip, for example, clips onto a folded bag, in order to maintain a bag's seal. However, the bag clip is bulky and inconvenient, easy to break, and unattractive. It is clearly not the most desirable solution. Another proposed solution is simply moving the food from its original packaging to a zip lock bag, for example. However, such a solution increases the trash accumulated, and it is inconvenient to bring zip lock bags wherever you might purchase snacks. It is an object of this invention, therefore, to provide a convenient, easily applied sealing mechanism for use with common food packaging, in order to preserve freshness, and in order to prevent food items from escaping their original packaging.

SUMMARY OF THE INVENTION

A closure for reversibly closing a bag is disclosed in accordance with a preferred embodiment of the present invention. The closure comprises a strip comprising an adhesive bottom surface adapted to reversibly adhere to first and second regions of the bag, such that the bag is maintained in a closed state when the strip is adhered to both first and second regions, and the bag can be opened when the strip is adhered to less than both regions, wherein the strip further comprises a modified top surface.

In some preferred embodiments, the modified top surface comprises a decorative motif adapted to appeal to a particular group of consumers. In other preferred embodiments, the modified top surface comprises a textured surface adapted to facilitate application to the first and second regions of the bag. In yet other preferred embodiments, the strip comprises a shape adapted to appeal to a particular group of consumers and/or facilitate application and removal of the resealable strip. In other preferred embodiments, the strip comprises at least two of a decorative motif, a textured top surface, and a shape.

Preferably, the adhesive bottom surface comprises an adhesive selected from the group consisting of tackified rubber adhesive, tackified acrylic adhesive and untackified acrylic adhesive. The adhesive bottom surface may be configured for multiple applications and removals.

In another preferred embodiment, the strip may further comprise a backing adjacent the adhesive bottom surface, said backing configured for removal before the strip is adhered to the first and second regions of the bag.

In another variation to the closure, the strip may further comprise a non-adhesive handle.

In preferred embodiments, the bag is a potato chip bag.

In another preferred embodiment, the closure for reversibly closing a bag comprises a strip configured to span first and second regions of the bag. The strip comprises an adhesive bottom surface adapted to reversibly adhere to the first and second regions of the bag, such that the bag is maintained in a closed state when the strip is adhered to both first and second regions, and the bag can be opened by a user when the strip is peeled away from at least one of the regions; a modified top surface having a decorative motif and/or a textured surface; and a handle region at one end of the strip comprising a non-adhesive bottom surface, such that the user can readily grasp the handle and peel the strip away from at least one of the regions, thereby opening the bag.

In another preferred embodiment of the present invention, a system is disclosed for resealing open bags. The system comprises a dispenser configured to store a plurality of resealable strips and to facilitate dispensing of a single strip; and a plurality of resealable strips positioned within the dispenser, each strip comprising: an adhesive bottom surface adapted to reversibly adhere to a first folded region of an open bag and a second body region of the open bag, such that the open bag is resealed when the strip is adhered to both first and second regions and can be re-opened by a user when the strip is removed from at least one of the regions; a modified top surface having a decorative motif and/or a textured surface; and a handle region at one end of the strip comprising a non-adhesive bottom surface, such that the user can grasp the handle region to apply or remove the strip, thereby resealing or re-opening the bag, respectively.

In a variation to the system, the dispenser may further comprise a bottom surface to which one of the plurality of resealable strips adheres; a top movable between a closed configuration and an opened configuration; at least one catch; and a bracket having a latch mechanism for engaging the at least one catch.

In another variation, the system may further comprise a cuff within which the bracket is disposed, wherein the cuff is configured to be worn on a wrist of a user.

In another variation, the bracket may further have a bottom surface adapted to fasten to a mounting surface. The bottom surface of the bracket may comprise an adhesive.

In another variation to the system, the plurality of strips may comprise an elongate tape configured as a roll, from which individual strips can be removed in pre-determined lengths. Preferably, the tape further comprises perforated junctions between individual strips.

In another variation to the system, the dispenser may comprise a laminated sheet in which the plurality of strips are positioned, wherein individual strips can be peeled away from the laminated sheet.

BRIEF DESCRIPTION OF THE DRAWINGS

The preferred embodiments of this invention, illustrating all its features, will now be discussed in detail. These embodiments depict the novel and nonobvious method and resealable strips of this invention shown in the accompanying drawings, which are for illustrative purposes only. The drawings include the following Figures, with like numerals indicating like parts.

DETAILED DESCRIPTION OF THE PREFERRED EMBODIMENT

Figure 1:
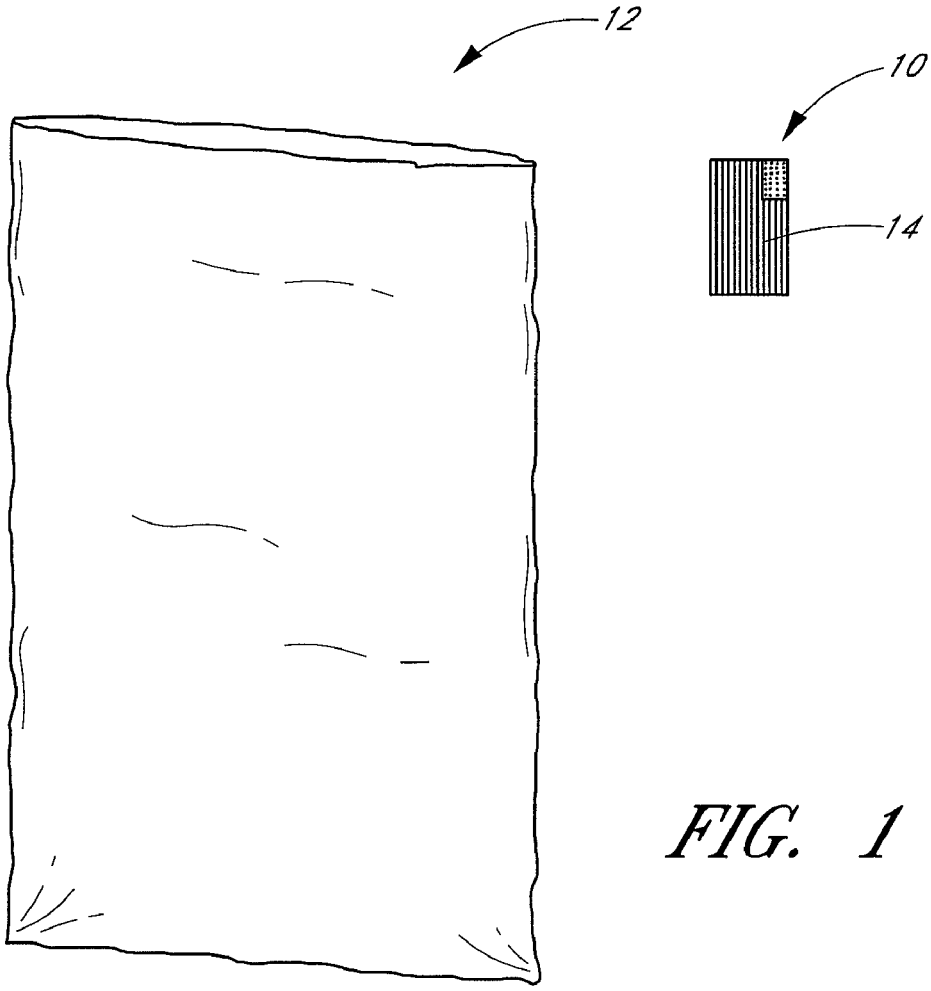
FIG. 1 shows a perspective view of one embodiment of a resealable strip according to the present invention, and exemplary food packaging to which the resealable strip may be affixed.

FIG. 1 illustrates one embodiment of the present invention in an unattached configuration. The resealable strip 10 of the present invention is shown adjacent an opened bag 12. In operation, the resealable strip 10 may be used to seal such a bag 12, thereby preserving the freshness of the contents of the bag 12 and preventing such contents from escaping the confines of the bag. As used herein, the term, "seal," has a broad definition and indicates some occlusion between an interior volume and an external environment. This term should not be interpreted to refer only to an air-tight, fluid-tight, or otherwise absolute sealing function. In a preferred embodiment, the bag 12 is sealed such that the contents are in substantially limited contact with the external environment.

As illustrated, the bag 12 may comprise a potato chip bag that may be composed of any of a variety of film-type materials, as is well known to those of skill in the art. The resealable strip 10 may also be used with other types of bags and materials, and the specifications of the resealable strip 10 may be modified as needed, in keeping with the invention, in order to suit these other bag applications. The bag 12 is also shown in an opened configuration, thus exposing the contents of the bag (potato chips, in this illustration) to the external environment. As is well known to those of skill in the art, potato chips, for example, will rapidly become stale if they remain in fluid contact with the external environment. However, this process may be slowed dramatically if the air flow among these chips is even partially restricted. Of course, it is also advantageous to close the bag 12 in some way so as to prevent accidental spillage of the potato chips contained therein.

Thus, in accordance with the present invention, it is desirable to seal the bag 12 in some way after opening it and eating some of the potato chips. The resealable strip 10 serves this purpose. In a preferred embodiment, the resealable strip 10 has a top surface 14 and a bottom surface 16, as may be seen more clearly in FIG. 1A. When applied, the bottom surface 16 of the resealable strip 10 contacts the bag 12, and the top surface 14 faces the user (as may be seen in FIG. 2). In order to seal the bag, at least a portion of the bottom surface 16 comprises an adhesive that may adhere to the film-type material from which the bag 12 is manufactured. In one preferred embodiment, the adhesive is adapted to retain its adhesive properties (e.g., remains capable of adhering to the bag material) through more than one, preferably more than two, repeated cycles of application and removal, such that the same resealable strip 10 may be peeled apart and then reapplied multiple times before it must be replaced.

The adhesive may comprise any of a number of adhesives well known to those of skill in the art, including water-based, solution or hot melt adhesives. In a preferred embodiment, the adhesive comprises a pressure sensitive adhesive, and may be chosen from among tackified rubber adhesives, tackified acrylic adhesives or untackified acrylic adhesives, styrene-isoprene block copolymers, acrylic ester-vinyl acetate copolymers, ethylene-vinyl acetate copolymers or other adhesives well known to those of skill in the art. In a further preferred embodiment, as an example, the adhesive may be chosen from among the adhesives sold under the trademarks MULTI-LOK, NACOR, MULTI-LOK 38-454A and NACOR 38-4554 sold by National Starch and Chemical Company in Bridgewater, N.J.

In order to protect the resealable strip's 10 adhesive bottom surface 16, the resealable strip 10 may further comprise a backing (not shown) that overlays this bottom surface 16. The backing may be peeled away from the bottom surface 16 prior to application and may have one or more tabs to facilitate grasping the backing. The backing may also allow multiple resealable strips 10 to lay atop one another without the top surface 14 of one strip adhering to the bottom surface 16 of an adjacent strip.

Figure 1A:
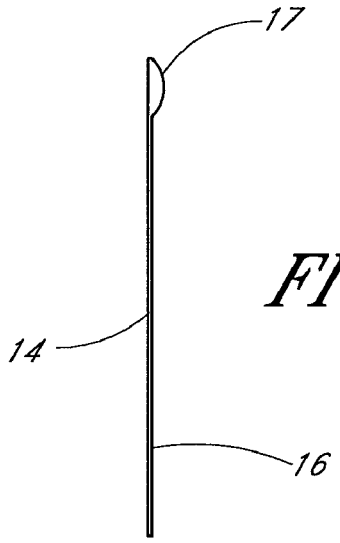
FIG. 1A shows a side elevational view of the embodiment of the resealable strip illustrated in FIG. 1.

The resealable strip 10 may further comprise a handle 17, as best seen in FIG. 1A. The handle 17 is preferably not coated with adhesive and may be used to facilitate finding and grasping an end of the strip, and holding the resealable strip 10 without getting adhesive on a user's hands. The handle 17 may also be used to conveniently remove the resealable strip from an attached configuration with the bag 12, since the handle 17 will extend at least partially above the surface of the bag as it has no adhesive on its bottom surface.

Figure 6:
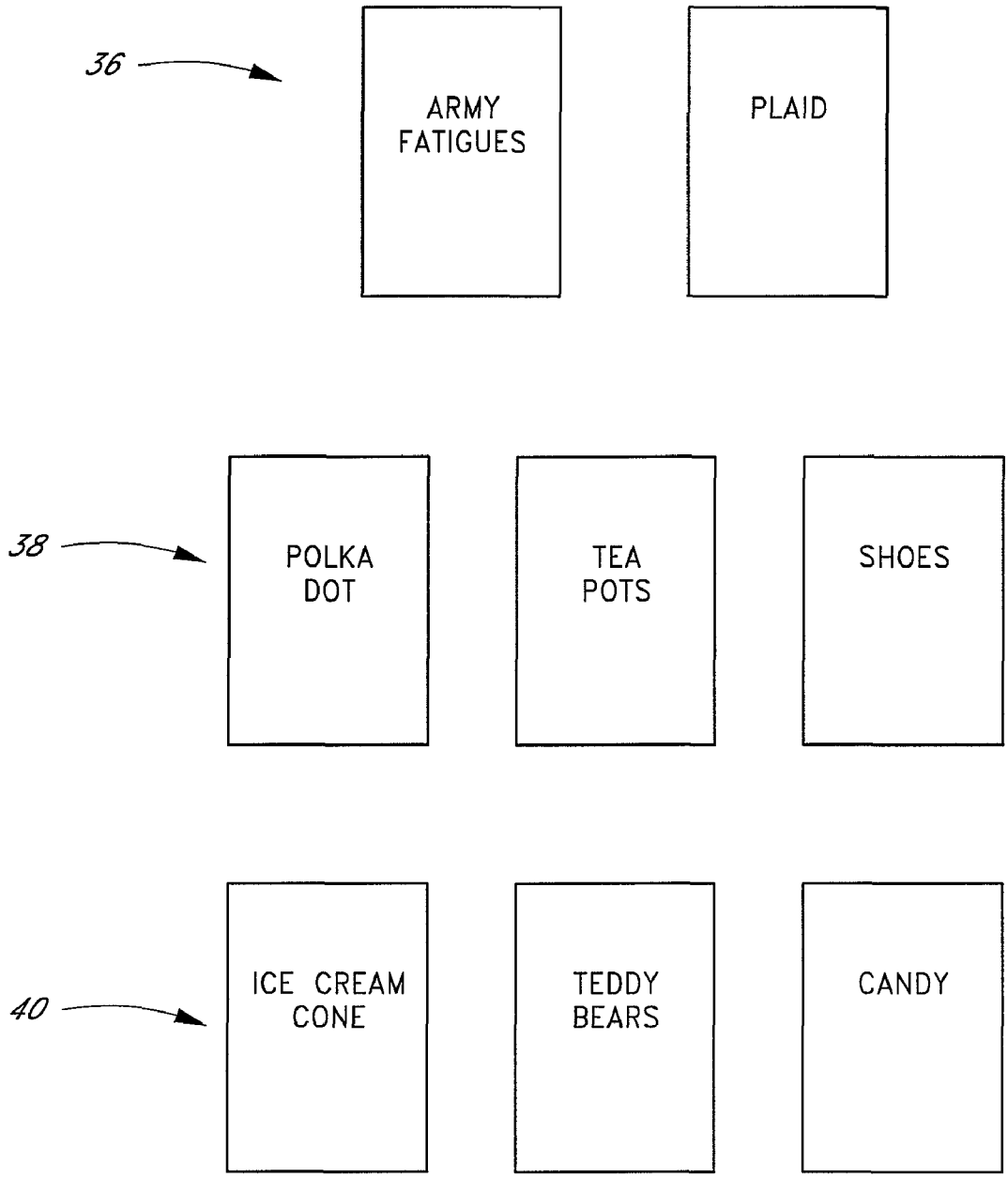
FIG. 6 shows a top view of a group of designs that may decorate the embodiment of the resealable strip illustrated in FIG. 1.
Figure 7:
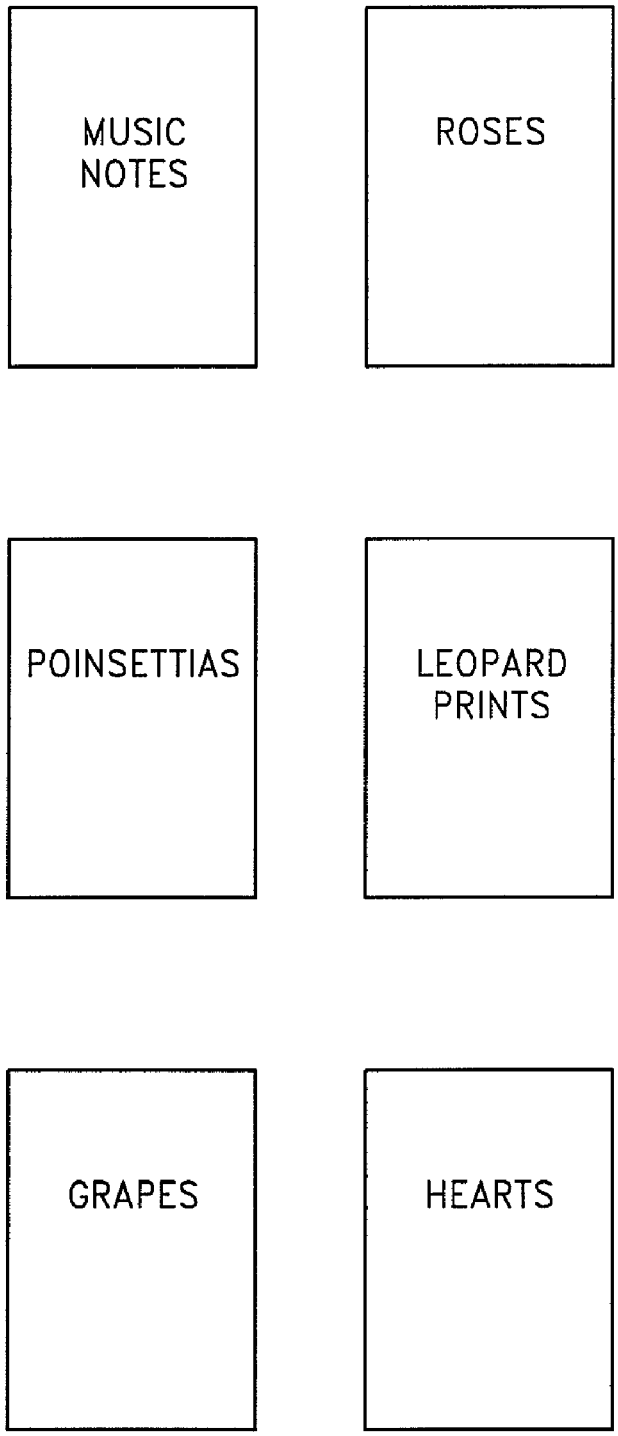
FIG. 7 shows a top view of another group of designs that may decorate the embodiment of the resealable strip illustrated in FIG. 1.

In order to make the resealable strip 10 more functional and attractive to consumers, in a preferred embodiment, the top surface 14 of the resealable strip 10 is modified relative to the bottom, adhesive surface. For example, the top surface may be laminated and may incorporate any of a number of functional and/or decorative features. The top surface 14 may include a textile layer, a different polymeric layer, a textured surface, etc., which may enhance both the strength and tactile feel of the strip. In addition or in the alternative, the top surface may, as illustrated, have printed thereon an aesthetically pleasing image, such as the American flag, that may encourage the user to apply the resealable strip 10 to a bag 12. The methods of printing such designs on the material of resealable strips 10 are well known to those of skill in the art, and may depend upon the material from which the resealable strips 10 are formed and/or on the top surface modification. In another embodiment, the top surface 14 may incorporate a combination of colors and textures that are aesthetically pleasing and/or functionally improved. FIGS. 6 and 7, which will be further discussed below, illustrate some possible designs. In another embodiment, the top surface 14 of the strips may incorporate an attractive three-dimensional shape extending from the surface of the bag 12. In yet another embodiment, the top surface 14 may further incorporate attractive and/or fanciful smells. In yet another embodiment, the top surface may be modified to include different names and/or initials, thereby identifying the owner of the opened/resealed bag among a family or group of users. There are, of course, a variety of decorative features that may be incorporated into different resealable strips.

The resealable strip 10 may be manufactured from any one of a number of materials well known to those of skill in the art. In one embodiment, the resealable strip principally comprises a polymer. In another embodiment, the resealable strip may comprise a paper or fabric compound. The resealable strip 10 may also be made in any of a number of shapes and sizes. In a preferred embodiment, the resealable strip is 1" wide by 3" long. In another embodiment, the strip is 1½" wide by 3½" long. Of course, in other embodiments, the shape of the resealable strip 10 may incorporate decorative features and may comprise a star, for example, or a cut-out of an automobile.

Figure 2:
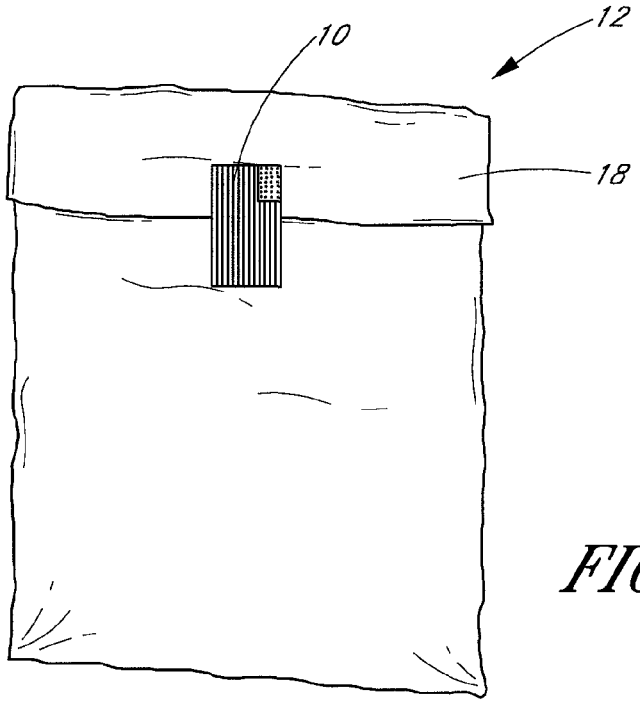
FIG. 2 shows a perspective view of the resealable strip and exemplary food packaging of FIG. 1 in an attached configuration.

One embodiment of the present invention is illustrated in FIG. 2 as applied to a bag 12. In a preferred method of application, one or more folds 18 are created at the open end of the bag 12 in order to press the material of the bag 12 into a relatively sealed arrangement. Thus, a temporary seal is created between the sides of the bag 12 at or near the folds 18. In order to maintain this seal, the folds 18 in the bag 12 must be maintained, and the resealable strip 10 may be used to maintain these folds.

In the illustrated embodiment, a longitudinal axis of the resealable strip 10 is aligned normal to a longitudinal axis of the folds 18 in the bag 12. Of course, in other embodiments, the resealable strip 10 may be oriented differently. The resealable strip 10 is preferably arranged to contact and adhere to both the folded and unfolded portions of the bag 12, maintaining the folds 18 in a sealing configuration. In this embodiment, it may be noticed that the top surface 14 of the resealable strip 10 is plainly visible, and it is therefore advantageous that this top surface 14 have an attractive design. Of course, in other embodiments, the attractive design may take the form of a particular shape of the resealable strip 10 itself.

In order to reopen the bag 12, the resealable strip 10 may be peeled away from the surface of the bag 12, and the bag 12 may be unfolded. In a preferred embodiment, the handle 17 is used to grasp the resealable strip 10 as it is peeled away. When the bag 12 is in an unfolded configuration, the resealable strip 10 may be left in a position adhering to a side of the bag 12. Alternatively, the resealable strip 10 may be removed and left on a piece of storage paper (such as, wax paper), or may be disposed of. When the user wishes to refold and reseal the bag 12, the same resealable strip 10 or another resealable strip may be used to seal the folds 18 in place as discussed above. Thus, a large bag of potato chips may be consumed in multiple sessions, between which the bag may be sealed to preserve freshness.

In one preferred embodiment, the strips may be dispensed in a roll, such as, for example, a tape dispenser. In one variation, the strips may be scored or perforated to allow easy removal of a predetermined length. In another variation, the strips may comprise a substantially continuous length of tape, wherein the dispenser is adapted to cut the tape into conveniently-sized strips for use. With respect to the tape dispenser embodiments, the configuration of the tape dispenser itself may vary among known dispenser designs and include single roll dispensers and multiple roll dispensers. In the case of a system comprising a multiple roll dispenser, the system may include in preferred embodiments, a variety of different top surface decorations, e.g., a family pack, with different patterns and/or textures being advantageously provided for each member of the family.

Figure 3:
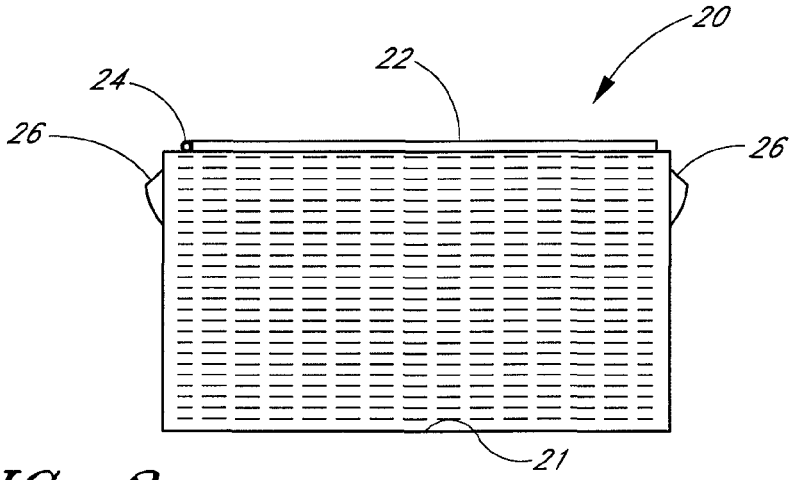
FIG. 3 shows a side elevational view of one embodiment of a container for dispensing resealable strips.

In FIG. 3, another container 20 from which the resealable strip 10 may be dispensed and sold is illustrated. In such a container 20, a number of resealable strips lie atop one another in storage, as illustrated by the horizontal lines in FIG. 3. In one embodiment, the bottom surface 16 of one resealable strip lies directly against and at least partially adheres to the top surface 14 of a resealable strip below. However, in a preferred embodiment, the adhesive on the bottom surface 16 of the top resealable strip tends not to leave an adhesive residue on the bottom resealable strip, at least in part because of a laminate or otherwise modified structure on the top surface 14 of the bottom resealable strip. At the bottom of the container 20, the bottom resealable strip lies directly against and at least partially adheres to a bottom surface 21 of the container, thereby at least partially adhering all of the resealable strips within the container 20. Of course, in other embodiments, the resealable strips may be sold on pieces of backing paper adjacent one another, but not stacked atop one another.

In order to remove the resealable strips from within the container 20, a top 22 is movable from a closed configuration (illustrated in FIG. 3) to an opened configuration (not shown). The top 22 preferably rotates about a hinge 24 in order to move into an opened configuration. The hinge 24 may comprise any of a number of hinges well known to those of skill in the art, including a pair of elements rotatable with respect to one another, or a piece of relatively thin material. Of course, in other embodiments, the top 22 may be attached to the container 20 by some other means, or there may be no top at all. Once the top 22 is moved into an opened configuration, a resealable strip may be removed by grasping it by its handle and pulling it from its adhesive connection with the resealable strip below it.

The container 20 may preferably have catches 26 disposed on two of its sides. The catches 26 comprise protrusions in the illustrated embodiment. In other embodiments, the catches 26 may comprise divots, into which a latch mechanism may protrude. In still other embodiments, the container 20 need not have a catch 26 at all.

Figure 4:
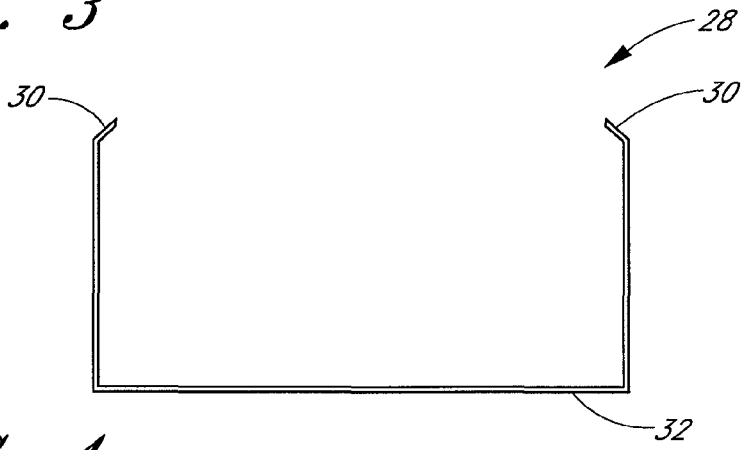
FIG. 4 shows a side elevational view of one embodiment of a bracket for receiving the container of FIG. 3.

In FIG. 4, a bracket 28 is illustrated, into which the container 20 may be placed. In a preferred embodiment, the bracket 28 has latch mechanisms 30 disposed on two sides of the generally hollow rectangular box comprising the bracket 28. The latch mechanisms 30 are preferably configured to interact with, and latch, the catches 26 of the container 20. Thus, a container 20 may be snapped into engagement with a bracket 28. In a preferred embodiment, once emptied, the container 20 may be snapped out of engagement with the bracket 28 and replaced by a new container.

The bracket 28 may further have mounting tape or adhesive on its bottom surface 32. In this way, the bracket 28 may be relatively permanently mounted and stored in a pantry or drawer, for example. As more containers are bought, they may be moved into latched engagement with the bracket 28, such that the resealable strips may be easily found in a household. In another embodiment, the bracket 28 may be relatively permanently mounted by other means well known to those of skill in the art, such as screws, nails or other mounting hardware.

The bracket 28 and container 20 are preferably made of fairly rigid plastic materials. Of course, other embodiments are also possible, and the materials from which the bracket 28 and container 20 are manufactured should not be limiting.

Figure 5:
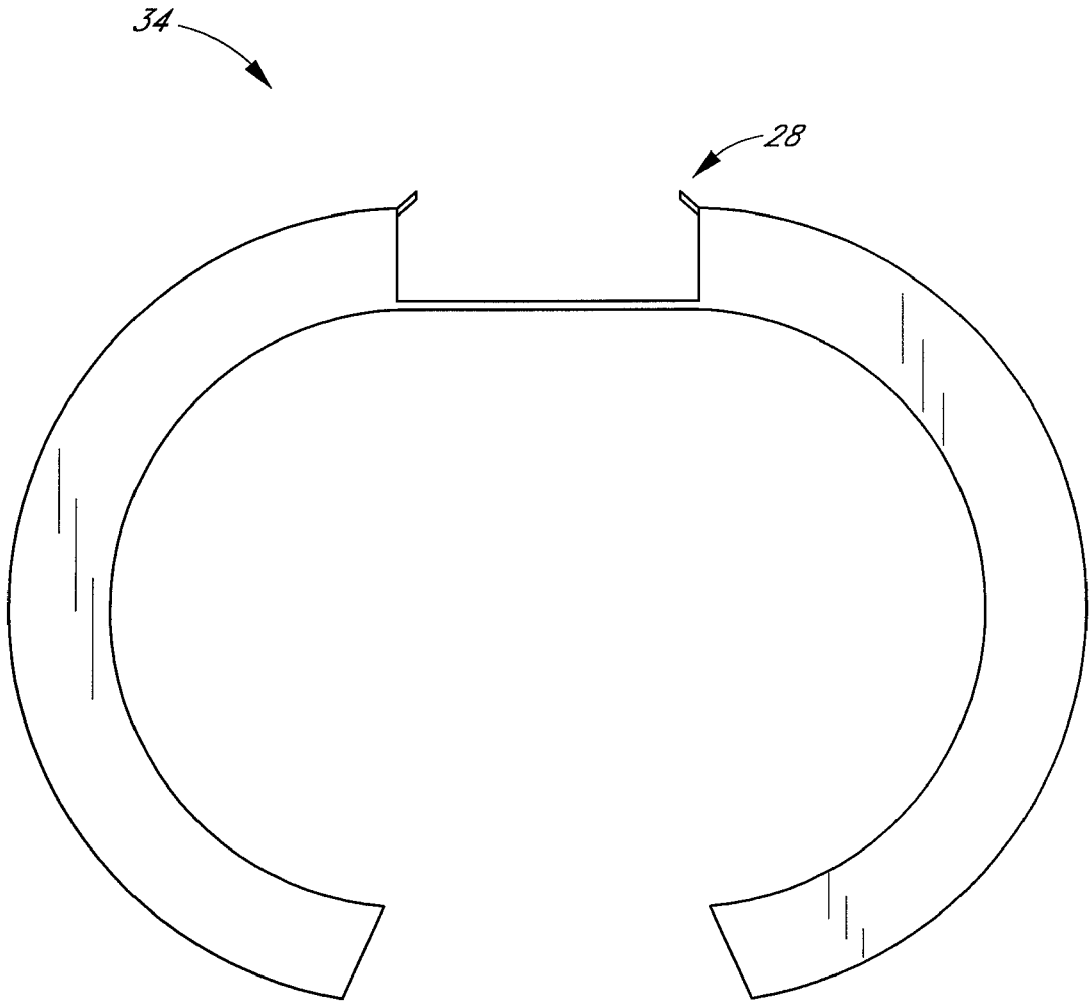
FIG. 5 shows a side elevational view of a second embodiment of a bracket for receiving the container of FIG. 3.

In FIG. 5, another embodiment of a bracket 28 is illustrated, wherein the bracket 28 is configured on a cuff 34, or wrist band, that may be worn on a user's wrist. The cuff 34 may be particularly useful in applications where a number of resealable strips 10 will be applied to multiple packages. In a preferred embodiment, the bracket 28 functions similarly to the bracket described above with reference to FIG. 4. In a preferred embodiment, the cuff 34 comprises a piece of flexible plastic that is lightweight and comfortable for a user to wear. Of course, other locations and orientations for the location of a bracket 28 are contemplated.

FIGS. 6 and 7 illustrate some decorative top surfaces 14 for the resealable strips 10. FIG. 6 illustrates three rows 36, 38, 40 that may be particularly attractive to men, women and children, respectively. FIG. 7, on the other hand, illustrates some decorative top surfaces 14 that are more unisex and represent a particular theme. In other embodiments, the top surfaces 14 may incorporate graphics representing different religious faiths, popular culture, sub-cultures, etc. As is well known to those of skill in the art, a variety of decorative features may be incorporated in keeping with the present invention.

Although not shown, in a preferred embodiment, the resealable strips 10 sold in a particular container 20 may have identical decorative top surfaces 14. However, in other embodiments, a variety of resealable strips 10 may be sold in a single container 20 to enhance a consumer's aesthetic variety. Moreover, the containers 20 may contain a variety of resealable strips 20 relating to a particular theme, such that the same group of consumers is likely to find all of the designs in a particular container 20 attractive.

A variety of resealable strips and potential packaging for these resealable strips have been disclosed in detail in connection with various embodiments of the present invention. These embodiments are disclosed by way of examples only and are not to limit the scope of the present invention, which is defined by the claims that follow. One of ordinary skill in the art will appreciate many variations and modifications within the scope of this invention.

What is claimed is:

1. A system for resealing open bags comprising; a dispenser configured to store a stack of non-coplanar resealable strips positioned within said dispenser with a lower surface of each upper strip having a parallel overlying relationship to upper and lower surfaces of each strip below said upper strip, each strip comprising, an adhesive bottom surface adapted to reversibly adhere to a first folded region of an open bag and a second body region of the open bag, such that the open bag is resealed when said strip is adhered to both first and second regions and can be re-opened by a user when said strip is removed from at least one of the regions, said dispenser being removably fittable into a recess of a bracelet, said dispenser comprising;

a bottom surface to which one of the stack of resealable strips adheres; a top movable between a closed configuration and an opened configuration; at least one catch; and a bracket having a latch mechanism for engaging the at least one catch, a handle region at one end of each said strip comprising a non-adhesive bottom surface, such that a user can grasp the handle region to apply or remove said strip, thereby resealing or re-opening said bag, respectively, and a dispensing bracelet for receiving said dispenser for storing said stack of strips, said dispensing bracelet comprising an arcuately curved ring-shaped band having a concave inner circumferential surface for fitting over a wrist of a user and a convex outer surface having therein a recess sufficiently deep to receive therein a said dispenser for storing said stack of strips with a top strip of the stack in substantially flush alignment with said convex outer surface of said bracelet.

2. The system of claim 1, wherein the bracket further has a bottom surface adapted to fasten to a mounting surface.

3. The system of claim 2, wherein the bottom surface of the bracket comprises an adhesive.

4. The system of claim 1, wherein the dispenser comprises a laminated sheet on which the plurality of strips are positioned, wherein individual strips can be peeled away from the laminated sheet.

* * * * *